United States Patent [19]

Laske et al.

[11] Patent Number: 4,683,667

[45] Date of Patent: Aug. 4, 1987

[54] STEAM DRYER FOR PRESSED FIBROUS MATERIAL

[75] Inventors: Gerd Laske, Brunswick; Peter Valentin, Walldorf, both of Fed. Rep. of Germany

[73] Assignee: Braunschweigische Maschinenbauanstalt Aktiengesellschaft, Brunswick, Fed. Rep. of Germany

[21] Appl. No.: 880,165

[22] Filed: Jun. 30, 1986

[30] Foreign Application Priority Data

Jun. 29, 1985 [EP] European Pat. Off. ..... 85108114.1

[51] Int. Cl.[4] ..... F26B 15/06

[52] U.S. Cl. ..... 34/203; 34/216

[58] Field of Search ..... 34/203, 205, 207, 208, 34/211, 216, 217, 82

[56] References Cited

U.S. PATENT DOCUMENTS

| | | | |
|---|---|---|---|
| 3,335,499 | 8/1967 | Larsson | 34/212 |
| 3,374,106 | 3/1968 | Thygeson, Sr. | 34/207 |
| 4,308,667 | 1/1982 | Roos et al. | 34/203 |
| 4,462,170 | 7/1984 | Burkall | 34/82 |

FOREIGN PATENT DOCUMENTS

0058651A1 8/1982 European Pat. Off. .

*Primary Examiner*—Larry I. Schwartz

*Attorney, Agent, or Firm*—W. G. Fasse; D. H. Kane, Jr.

[57] ABSTRACT

A steam dryer for pressed fibrous material, such as sugar beet cossettes, has a pressurized, horizontally arranged pipe or drum (1) closed at both ends and provided with a diametrically opposed supply manifold and exhaust manifold piping (5, 6) for the steam. At least one heat exchanger (7) is arranged in a lengthwise half of the pressurized pipe and extends across the entire steam flow-through cross-section. Endless loop screen or mesh belts (8, 8', 8'') are arranged one above the other in the other lengthwise half of the pressurized pipe. These belts are driveable in opposite directions for conveying the material to be dried, and to transfer the material from an upper belt to a lower belt. The mesh belts (8) define separation planes between pressure and exhaust chambers (24, 25) which are alternatingly arranged above and below each respective mesh belt. The pressure chambers (24) comprise inflow cross-sections open to the lengthwise half with the heat exchanger (7), and the exhaust chambers (25) comprise outflow cross-section open to at least one exhaust space (26). The steam flows in an essentially closed loop cycle, except for a small portion which is extracted and replaced by fresh steam, whereby the steam passes through the heat exchanger (7) and the separate mesh belts as it flows through this cycle.

12 Claims, 4 Drawing Figures

STEAM DRYER FOR PRESSED FIBROUS MATERIAL

FIELD OF THE INVENTION

The invention relates to a steam dryer for pressed squeezed fibrous material, especially lixiviated and possibly pre-dried sugar beet cossettes. In such a steam dryer the steam flows primarily through a circuit or loop arrangement in direct contact with the material to be dried, whereby the material is moved along a conveyor path.

DESCRIPTION OF THE PRIOR ART

In the interest of conserving energy and reducing the burdening of the environment, efforts have been made to make the previously large expenditure of primary energy more cost efficient and ecologically sound by using steam dryers for the drying of pressed fibrous material, especially sugar beet cossettes. The steam necessary for running the steam dryers can easily be provided by the steam generation plants already existing in the factories. The steam cycles through an essentially closed loop circuit in the steam drier. However, that portion of the steam which is extracted from the cycle and is replaced by steam withdrawn from the material can be directed to other apparatus in order to utilize the residual heat in the steam. For example, the steam may be passed through heat exchangers for an evaporative crystallization, in order to achieve an improved efficiency in the use of energy.

Prior art steam dryers for pressed fibrous materials, such as sugar beet cossettes, typically comprise a drum with internal attachments and mounted for rotation around its longitudinal axis. Steam flows through the drum during its rotation, whereby a direct intimate contact between the steam and the fibrous material is achieved in that the material is carried along by the drum through part of its rotation, and then falls freely downwardly through the inner drum space until it again falls on the drum wall. Due to this motion the material is continuously loosened and brought into contact with the steam.

The drying effect of these rotatable steam penetrated drums is relatively small, because an intimate interaction between the fibrous material particles and the steam is practically only achieved during the free fall of the material particles while the steam merely passes over the material remaining on the drum wall without deeply penetrating this material on the drum wall.

Further, steam dryers have become known, for example in the European Patent Publication EP No. 0,058,651, wherein animal feed of sugar beet cossettes is prepared by pre-heating and pressing the cossettes and then loosening the cossettes after the pressure is removed and before loading into a steam-penetrated pipe. These particles are then carried along by the stream of flowing steam. The steam-penetrated pipe thereby forms a part of the closed circuit arrangement of the dryer, which essentially comprises a meandering arrangement of steam pipes through which the cossettes are conveyed by means of the flowing stream of steam. At the exit of the meandering pipe arrangement the particles are removed from the steam by a separator, while the steam continues to circulate through the closed loop circuit, except for a small amount of steam, which is respectively extracted and replaced by fresh steam.

In this known arrangement, relatively high stream velocities of the steam are necessary in order to achieve an effective transport of the cossettes through the meanderingly arranged pipes, and to prevent the cossettes from being deposited on the pipe walls. The operating conditions of such a steam dryer are only variable over a small range, since the stream velocity of the steam is determined by the necessity of effectively conveying the cossettes through the meandering pipes. Thus, the processing time for the cossettes during the drying process practically cannot be adjusted. It is therefore necessary to introduce into the dryer only cossettes having a constant moisture content. Further, the quantity of cossettes introduced into the dryer per unit time must be essentially constant. Even with high stream velocities it is nearly impossible to avoid the depositing of cossettes on the pipe walls, especially at the corners, whereby the removal of the interfering deposits entails a high cost in the form of down time for cleaning the pipes. Besides, the known dryer requires a relatively large structural expenditure as well as a large space.

OBJECTS OF THE INVENTION

In view of the foregoing it is the aim of the invention to achieve the following objects singly or in combination:

to construct a compact and simple steam dryer for pressed fibrous material;

to assure an energy efficient and maintenance cost-efficient operation of such a dryer;

to achieve a uniform and adjustable processing of all particles of a material such as sugar beet cossettes in such dryer;

to permit varying the throughput of material per unit of time within a wide range;

to allow a variable steam flow rate and adjustable duration of interaction between the particles and the steam in such a dryer;

to effectively dry particles of variable size, dampness, and load volume per unit time in such a dryer; and to prevent the accumulation or depositing of particles in such a dryer.

SUMMARY OF THE INVENTION

These objects have been achieved by a steam dryer for pressed fibrous material according to the invention, comprising a pressurized, horizontally arranged pipe which is closed at both ends. The pressurized pipe is provided with diametrically opposed steam supply and steam exhaust manifold arrangements. At least one heat exchanger is arranged in a lengthwise half of the pressurized pipe, whereby this heat exchanger extends across the entire flow-through cross-section for the steam. The other lengthwise half of the pressurized pipe is provided with endless loop screens or mesh belts which are arranged one above another and are driveable in opposite directions in the manner of a conveyor belt dryer. These mesh belts convey the material to be dried and transfer the material from belt to belt. A supply-or feed-arrangement is provided above the upper mesh belt and an output or discharge device is provided underneath the lowest mesh belt in order to respectively supply and discharge the material to be dried. The mesh belts define a separation plane between pressure and exhaust chambers which are alternatingly arranged above and below each mesh belt. The pressure chambers comprise inflow ports open to the lengthwise half of the pressurized pipe with the heat exchanger, and the exhaust chambers comprise outflow ports open to at least one exhaust space.

Due to this described construction of the present steam dryer, a penetration and through-flow of the steam through the layer of material carried on the mesh belts is achieved in a direction perpendicular to the plane of the belts, whereby the steam may flow around and in intimate contact with all of the material particles or cossettes on the mesh belts. In such an arrangement the stream flow velocity of the steam in the empty spaces or cavities within the layer of material is larger than the average supply flow velocity of the steam. Unsaturated steam is used in the operation of such a steam dryer, so that an increased moisture transfer from the material particles or cossettes into the unsaturated steam is achieved due to the substantial heating of the material. As a result, a favorable drying effect is achieved.

By means of the described arrangement and drive direction of the mesh belts, after material is supplied to the upper belt, the material is conveyed and then transferred to each respective lower belt. Thus, the layer thickness of the material on the belts may be adjusted to match the existing drying requirements by individually adjusting the drive velocity of the belt to different speed as needed. Similarly, the total processing time of the material in the steam flow may be adjusted over a large range of values by varying the movement velocity of the driven mesh belts in unison. The steam is directed through the pressure plenum to all the belts in parallel, so that the steam penetrating each material layer on the separate mesh belts comprises the same moisture absorption capacity for all belts.

It is especially advantageous to provide several separate exhaust plenums or spaces arranged next to one another along the length of the pressurized pipe, wherein each exhaust space is connected to the suction side of a blower. The pressure side of each blower is connected to the lengthwise half of the pressurized pipe comprising the heat exchanger. This lengthwise half of the pressure pipe forms or encloses a pressure plenum or space, which is fitted to the heat exchanger and is connected to each of the blowers. This feature assures a uniform steam through-flow through each mesh belt over its entire length.

It is advantageous if the separate exhaust plenums respectively extend across the entire cross-section of all the exhaust chambers, which lie one above another. However, despite this described separation of the exhaust spaces arranged next to one another, non-uniform or unequal steam through-flow of the separate mesh belt surfaces, or rather of the material layers on the belt surfaces, may occur. In order to achieve an assured uniform or equilibrated through-flow, an advantageous embodiment of the invention provides that the exhaust spaces are separated into separate parallel channels, each connecting to a single exhaust chamber. These parallel channels extend through the plenum where they merge into the suction duct of the respective blower. Separately controllable throttle flaps or dampers may be provided in each channel. By means of flow rate measurements in each channel, the throttle dampers may be individually adjusted so as to achieve a uniform through-flow of the steam through each material layer, or even to achieve any desired increased steam through-flow through any one or another of the material layers.

During the process of drying the material, it is unavoidable that small solid particles or light fibrous components are carried along with the steam as it passes through the material layers. Furthermore, it is desirable to maintain a uniform distribution of steam in the pressurized space, whereby the steam flows in a closed loop circuit. Therefore, a diffusing and cleaning screen made of cloth or mesh may be provided in the pressure plenum between the steam supply manifold and the heat exchanger. This screen should be so constructed and arranged that it is slightly billowed and moved by the steam flow passing through it, so that the screen is self-cleaning. The small particles and fibrous components which are separated from the steam flow by the screen can slide downwardly along the screen. An extraction conveyor screw is provided underneath the diffusing and cleaning screen to remove the small particles and light fibrous components.

The respective arrangement of the mesh belts is such that an upper conveying run of each conveying belt separates the corresponding pressure chamber from the respective exhaust chamber. The empty lower run of each mesh belt extends above the conveying run of the next lower mesh belt. Both runs of each mesh belt extend across the entire through-flow cross-section for the steam from the pressure chamber into the exhaust chamber. This feature assures that the carrying surface of the empty lower run of a belt faces downwardly and is essentially empty of material, which has already been transferred to the next lower belt at the transfer point. Thus, the empty lower belt run can be penetrated by the steam in a downward direction, or from the inside out, so to speak, whereby any material particles still clinging to the carrying surface, are carried downwardly by the steam onto the material layer on the conveying run of the next lower mesh belt, whereby an additional self-cleaning effect is achieved beyond the typical cleaning of such mesh belts in conveyor belt dryers, wherein additional mechanical cleaning means, such as brushes or the like, are arranged to clean the mesh belts.

The material transferred to the upper run of the lowest mesh belt has already been extensively pre-dried. The extraction of the remaining water for achieving the desired level of dryness, becomes more difficult as the concentration of salts and other water-binding compounds in the remaining water is increased. Therefore, it is advantageous to provide an additional heat exchanger extending across the inflow cross-section above the upper run of the lowest mesh belt. The use of this extra heat exchanger is especially advantageous, for example for drying sugar beet cossettes which are still wetted by syrup when they are finally transferred to the lowest mesh belt. The remaining water in this syrup can only be extracted by the steam at increased temperature.

In order to achieve the largest possible water extraction from the fibrous material it is advantageous to supply the material to the dryer at a relatively high temperature. For this purpose the supply feed arrangement may be provided with a pre-warming heater, which may, for example, be a worm screw heated by steam flowing through it.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

As shown in FIGS. 1 to 4, the steam dryer comprises a pressurized pipe or drum 1 which is closed at both ends and arranged with its axis lying horizontally. In practice this pressure pipe 1 may be rather long, and may comprise several segments, which are interconnected by flanges and appropriate seals. The pressurized pipe 1 is closed at its ends by dome-shaped caps 2. Manholes, not shown, with sealed lids may be provided in the end caps 2 as well as in the separate cylindrical sections of the pressurized pipe 1. These manholes allow easy access to the interior of the pressure pipe 1 for inspection or repair work.

Figure 2:
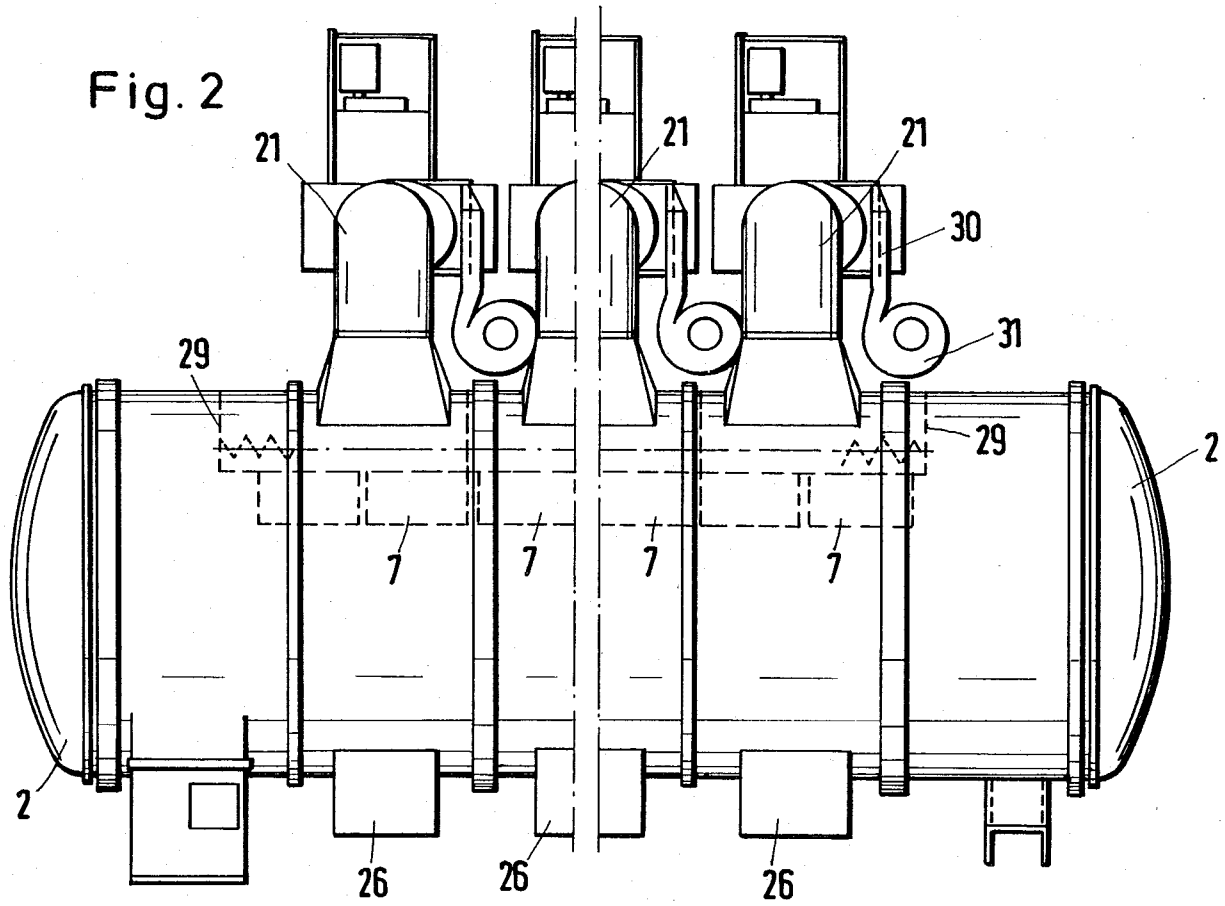
FIG. 2 is a top view of the arrangement according to FIG. 1.
Figure 3:
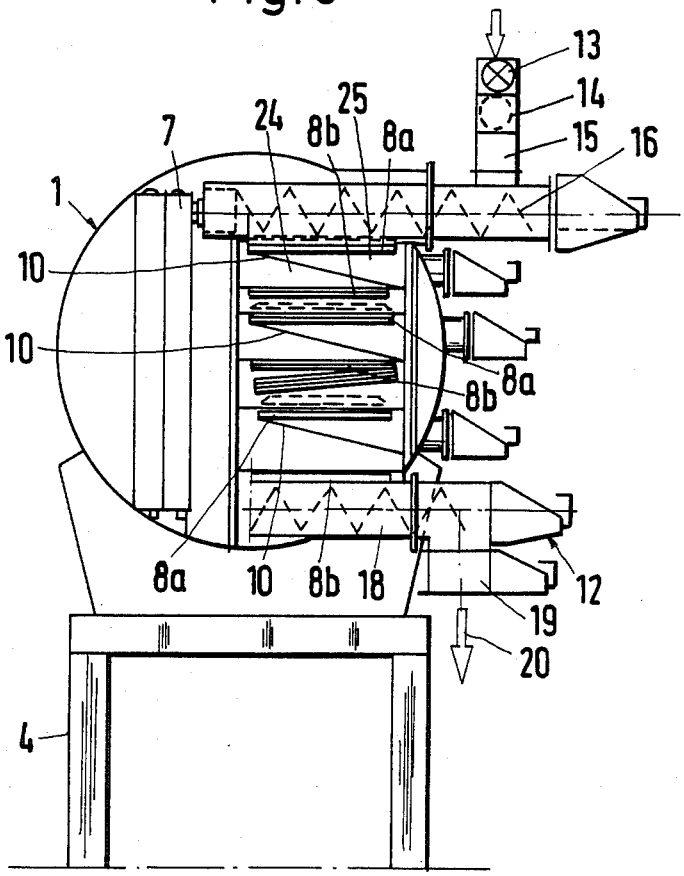
FIG. 3 shows a simplified section along the line A—A through the arrangement of FIG. 1.
Figure 4:
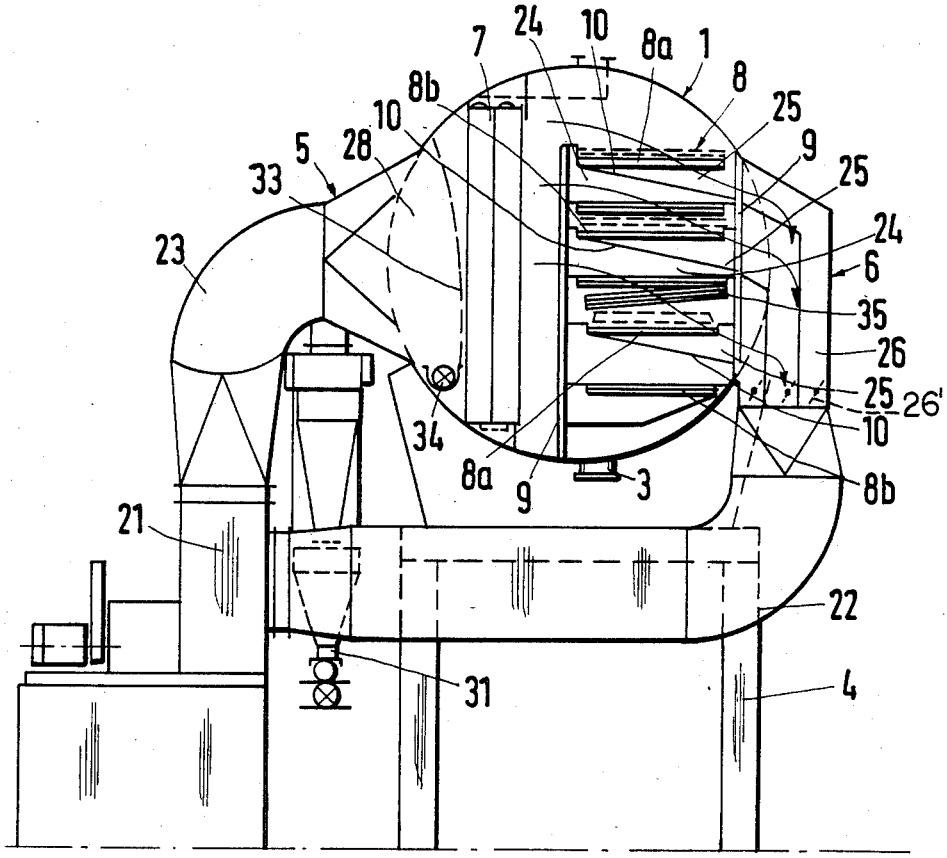
FIG. 4 shows a simplified section along the line B—B through the arrangement of FIG. 1.

As shown in FIGS. 3 and 4, the pressure pipe 1 is carried by a support frame 4. Steam supply piping 5 and diametrically opposed steam exhaust piping 6 is best seen in FIG. 4. The steam supply and exhaust piping 5 and 6 extends essentially along the entire length of the pressure pipe 1 as best seen in FIGS. 1 and 2.

A heat exchanger 7 is arranged within one lengthwise half of the pressure pipe 1, as shown in FIGS. 3 and 4. The heat exchanger 7 may comprise a row arrangement of separate smaller heat exchangers. The exchanger 7 is connected to a steam supply pipe shown symbolically at 17 in FIG. 1.

In the other lengthwise half of the pressure pipe 1, several endless-loop web or mesh belts 8, 8′ and 8″ are arranged one above the other. These belts are driven in opposite directions in the manner of a conveyor belt dryer. The invention is not limited to three mesh belts.

Figure 1:
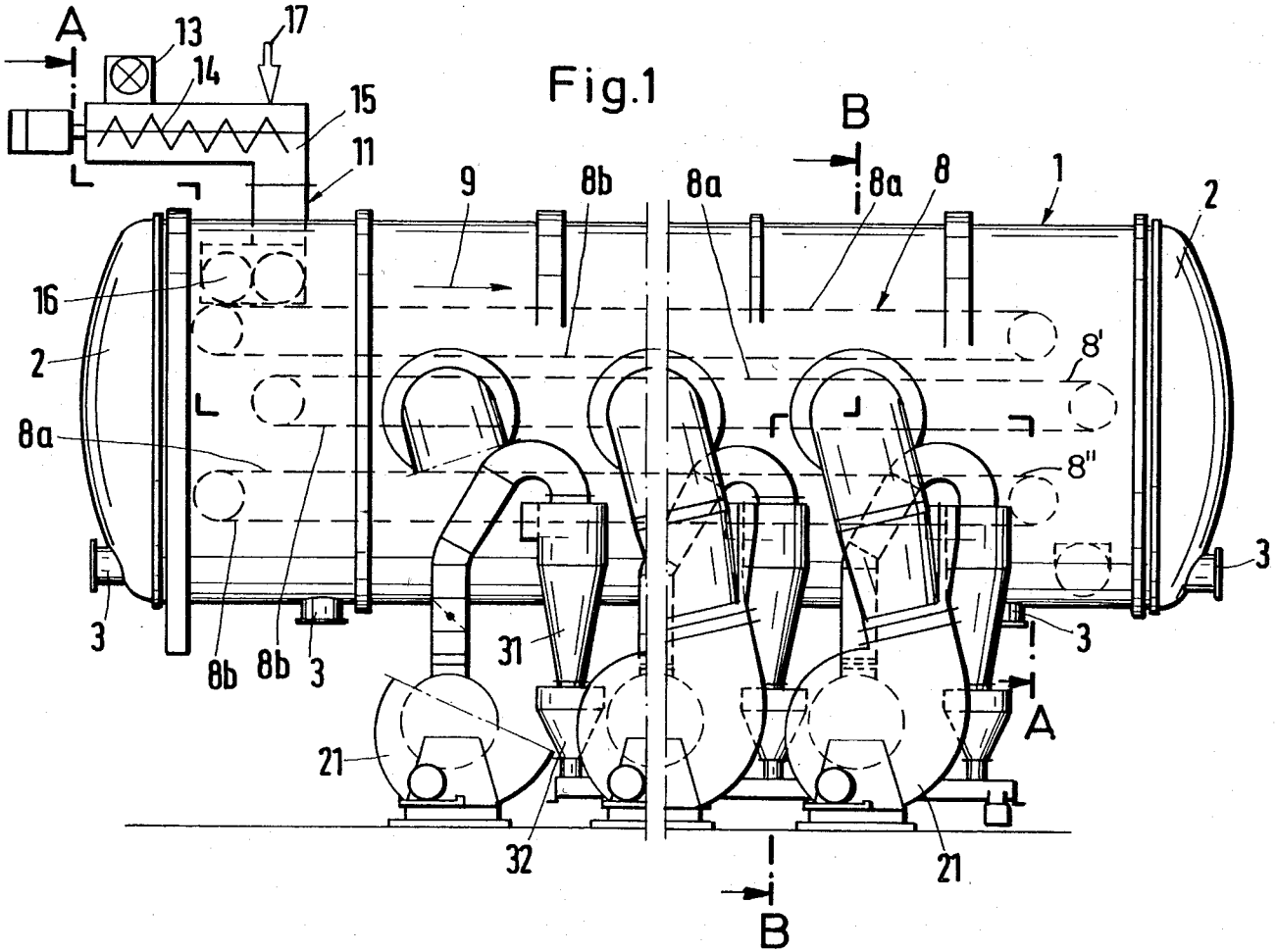
FIG. 1 is a side view of the dryer according to the invention particularly suitable for treating pre-dried sugar beet cossettes without showing the support structure for the pressurized pipe.

The uppermost mesh belt 8 is driven in the direction of arrow 9 as seen in FIG. 1. The several mesh belts 8, 8′, 8″ are stacked one above the other and staggered in their lengthwise direction for transferring the material to the respective lower belt. Thus, the material which is deposited on the upper run 8*a* of the uppermost mesh belt 8 is conveyed to the right end of the belt as seen in FIG. 1, and is then transferred to the next lower mesh belt 8′. The material is then transferred in a similar manner from the middle mesh belt 8′ to the lowest mesh belt 8″.

The mesh belts 8, 8′, 8″ are all carried by a mounting frame 9′ shown in FIG. 4. Partition walls 10 are attached one above the other to the mounting frame 9′, and extend in the lengthwise direction of the pressure pipe 1.

A supply feed arrangement 11 delivers the material to be dried to the upper mesh belt 8 or rather to the conveying run 8*a* of the belt 8. An output or discharge arrangement 12 is located beneath the lowest mesh belt 8″. In the embodiment shown especially in FIG. 1, the supply feed arrangement 11 comprises a bucket wheel 13 arranged above a driven conveyor worm screw 14. The worm screw 14 ends above a conveying shaft or duct 15 which leads to two distribution worm screws 16 located in the pressure pipe 1. The housing of the worm screw 14 is connected to a steam supply inlet 17 in the area of the junction with the duct or shaft 15. In this example the worm screw 14 is embodied as a ring worm screw which is hollow so that steam, e.g., may pass through the screw 14 for preheating the material being delivered to the pressure pipe 1.

As shown in FIG. 3, the discharge or output arrangement 12 comprises a discharge worm screw 18 which opens into a sluice 19 for directing the discharged material in the direction of the arrow 20 onto a further conveyor or other collection means not shown in the drawing.

Steam is directed in an essentially closed loop through the pressure pipe 1 in order to penetrate the layers of material on the upper runs 8*a* of the conveying belts 8, 8′, 8″. The steam is supplied to the pressure pipe 1 through the steam intake piping 5, and is removed from the pipe 1 through the steam exhaust piping 6. The piping 5, 6 is of conventional construction. In order to supply and distribute the steam, several blowers 21 are provided along the length of the pressure pipe 1. The vacuum or suction ducts 22 of the blowers 21 are connected to the exhaust piping 6, whereas the pressure ducts 23 of the blowers 21 are connected to the intake piping 5.

Due to the arrangement of the partition walls 10 in the mounting frame 9′ for the mesh belts 8, 8′, 8″, the penetrating steam flow through the upper runs 8*a* of the mesh belts 8, 8′, 8″ occurs in the direction given by the arrows shown in the right half of FIG. 4. Thus, the material on the upper conveyor runs 8*a* is penetrated from top to bottom in a direction practically perpendicular to the plane of the material layer, by the steam supplied by the blowers 21. Thus, pressure chambers 24 are formed above each conveying band 8*a*, between each upper run 8*a* and the respectively upper adjacent partition wall 10. Similarly, exhaust chambers 25 are formed beneath each conveyor run 8*a* in the space between each conveyor run 8*a* and the respectively lower adjacent partition wall 10. The exhaust chambers 25 open into exhaust spaces 26 which are further connected to the suction ducts 22 of the blowers 21. The conveyor runs 8*a* of the mesh belts 8, 8′, 8″ thereby form the separation planes between the pressure chambers 24 and the exhaust chambers 25.

There are several separate exhaust or outflow spaces 26 arranged next to each other along the length of the pressure pipe 1 as shown in FIG. 2. The exhaust chambers 25 each connect directly into the exhaust spaces 26 without any intermediate components. The end of each exhaust space 26 is connected to the suction side of the blower 21.

The exhaust spaces 26 may comprise separate parallel channels, each of which connects to a single one of the exhaust chambers 25. These channels extend through the exhaust spaces 26 to its connection with the suction duct 22. Each channel is provided with a separately controllable throttle damper 26′ as shown in FIG. 4. These throttle dampers may be used to compensate for varying flow resistance through the separate material layers on the upper conveyor runs 8*a*, whereby a uniform penetration and steam flow is achieved through each of the conveyor runs 8*a*, or rather through the material layers on these conveyor runs 8*a*.

On the steam supply side, the steam passes through the intake piping 5 to a pressure space 28 fitted to the heat exchanger 7 as shown in FIG. 2. Walls 29 extending from the heat exchanger 7 serve to close the ends of the pressure space 28, so that the supplied steam is forced to pass through the heat exchanger 7 and is not able to pass around the sides of the heat exchanger. The steam which is supplied under higher pressure by the blower 21 is heated in the heat exchanger 7, whereby the moisture absorption capacity of the steam is correspondingly increased.

A portion of the steam is continually extracted from the essentially closed loop circuit through a bypass duct 30 respectively attached to the pressure side of each blower 21 as shown in FIG. 2. Each bypass duct 30 is attached to a separator 31 through which the steam, which has been extracted from the circuit loop and cleaned of any small material particles which may have been carried in the steam, is distributed for further utilization, for example, for an evaporative crystallization in sugar factories.

Depending upon the respective amount of steam extracted from the cycle, an appropriate amount of fresh steam is introduced into the heating cycle. This fresh steam may be supplied by the steam production plant for example of a sugar factory. The steam supply and extraction is not shown in detail in the drawings, because these subsystems are well known and are not part of the invention.

As shown in FIG. 1, funnel-shaped collector chambers 32 are provided underneath the separators 31. These collection chambers simultaneously serve as settling chambers for the separated material, and are therefore connected to an output arrangement for the separated material.

A diffuser and cleaning screen 33 made of cloth or mesh is arranged in the pressure space 28 between the steam intake piping 5 and the heat exchanger 7 as shown by dotted lines in FIG. 4. This screen 33 cleans the steam flowing through the closed cycle of any light material particles which might be carried along by the steam flow. The screen 33 simultaneously serves to ensure a uniform flow characteristic of the steam. The screen 33 is advantageously loosely mounted to be billowed rather than tightly stretched across the pressure chamber 28 of the pressure pipe 1. An output worm screw 34 is arranged along the bottom of the screen 33 so that material particles which are separated from the steam flow by the screen 33 may slide on the screen downwardly for removal by the output worm screw 34.

As described above the upper conveyor runs 8*a* of the mesh belts 8, 8', 8'' form the respective separation planes between the pressure chambers 24 and the exhaust chambers 25. The return or empty lower runs 8*b* corresponding respectively to each conveying runs 8*a*, are arranged directly above the conveying runs 8*a* of the next lower mesh belt 8. Thus, the empty run 8*b* of the uppermost mesh belt 8 must first be penetrated by the steam before the steam reaches the material layer on the conveying run 8*a* of the next lower mesh belt 8'. The contact surface of the empty run 8*b* faces downwardly so that the steam flowing through it in a downwards direction removes any small material particles still clinging to the empty run 8*b* and carries such particles to the upper conveyor run 8*a* of the next lower mesh belt 8' or 8'', whereby a cleaning or scrubbing effect of the empty run 8*b* is achieved. Each empty run 8*b* simultaneously serves as a diffuser screen to improve the uniformity of steam flow penetrating the conveyor runs 8*a* located below the respective empty run 8*b*.

As further shown in FIG. 4, an additional heat exchanger 35 is arranged to extend across the steam flow cross-section above the lowest mesh belt 8''. This heat exchanger 35 further heats the steam penetrating the material on the lowest mesh belt 8'', whereby the final level of dryness of the material is considerably increased.

Although the invention has been described with reference to specific example embodiments, it will be appreciated, that it is intended to cover all modifications and equivalents within the scope of the appended claims.

What we claim is:

1. A steam dryer for drying pressed fibrous material, such as lixiviated or partially pre-dried sugar beet cossettes, wherein steam flows in an essentially closed loop circuit into intimate contact with said fibrous material, comprising a closed, pressurized substantially horizontally arranged cylindrical housing, steam supply means connected to said housing for supplying steam into said housing, steam exhaust means connected to said housing for removing steam from said housing, said steam supply means and said steam exhaust means being arranged in diametrically opposed positions on said pressurized cylindrical housing, at least one heat exchanger means arranged to extend across substantially an entire steam through-flow cross-section in a first lengthwise half of said pressurized cylindrical housing, a plurality of endless mesh belt conveyors arranged one above the other and driveable in opposite directions located in the other lengthwise half of said pressurized cylindrical housing for conveying said fibrous material and for transferring said fibrous material from an uppermost conveyor to successively lower conveyors, material feed-in means positioned above said uppermost conveyor, material output means positioned below a lowermost conveyor of said conveyors, said conveyor belts forming in said second lengthwise half of said housing several pressure chambers and exhaust chambers alternatingly arranged one above the other, whereby each of said mesh conveyor belts forms a separation plane between respective pressure and exhaust chambers, and at least one exhaust space, wherein said exhaust chambers comprise exhaust openings connecting to said exhaust space, and wherein said pressure chambers comprise inlet openings connecting said pressure chambers to said first lengthwise housing half in which said heat exchanging means is located, and wherein said exhaust space comprises several separate exhaust plenums (26) which are arranged next to one another along the length of said pressurized cylindrical housing, said dryer further comprising several blowers, whereby said exhaust plenums are each connected to the suction side of a respective blower, and wherein said first lengthwise half of said housing in which said heat exchanger is located, is connected to the pressure side of each of said blowers.

2. The steam dryer of claim 1, wherein each of said separate exhaust plenums extends across the cross-section of the exhaust chambers arranged one above the other.

3. The steam dryer of claim 2, wherein said exhaust plenums comprise separate exhaust channels, whereby each exhaust channel extends from one of said exhaust chambers to a suction duct of one of said blowers, said dryer further comprising separately controllable throttle means arranged in each of said exhaust channels.

4. The steam dryer of claim 1, further comprising a diffuser and cleaning screen arranged in said first lengthwise half of said housing between said steam supply means and said heat exchanger means, said diffuser and cleaning screen diffusing the steam flow through said heat exchanger and removing from said steam flow small light fiber particles which may be carried by said steam flow.

5. The steam dryer of claim 4, further comprising an output conveyor means arranged below said diffuser and cleaning screen, for discharging said light fiber particles.

6. The steam dryer of claim 1, wherein each of said mesh belt conveyors comprise a conveyor run (8*a*) and an empty run (8*b*), whereby said conveyor runs form said separation plane between a respective pressure chamber and exhaust chamber, and wherein said empty run (8*b*) of one mesh belt is arranged directly above a conveyor run (8*a*) of a respective neighboring lower conveyor, said conveyor runs (8*a*) and said empty runs (8*b*) extending across the entire steam through-flow cross-sectional area between said respective pressure chambers and exhaust chambers.

7. The steam dryer of claim 1, comprising an additional heat exchanger (35) arranged above the lowest of said mesh belt conveyors, whereby said additional heat exchanger extends across the entire steam through-flow cross-sectional area above said lowest mesh belt conveyor.

8. The steam dryer of claim 1, wherein said material feed-in means comprise material pre-heating means.

9. The steam dryer of claim 8, wherein said material pre-heating means comprise a ring worm screw through which steam may flow.

10. A steam dryer for drying pressed fibrous material, such as lixiviated or partially pre-dried sugar beet cossettes, wherein steam flows in an essentially closed loop circuit into intimate contact with said fibrous material, comprising a closed, pressurized substantially horizontally arranged cylindrical housing, steam supply means connected to said housing for supplying steam into said housing, steam exhaust means connected to said housing for removing steam from said housing, said steam supply means and said steam exhaust means being arranged in diametrically opposed positions on said pressurized cylindrical housing, at least one heat exchanger means arranged to extend across substantially an entire steam through-flow cross-section in a first lengthwise half of said pressurized cylindrical housing, a plurality of endless mesh belt conveyors arranged one above the other and driveable in opposite directions located in the other lengthwise half of said pressurized cylindrical housing for conveying said fibrous material and for transferring said fibrous material from an uppermost conveyor to successively lower conveyors, material feed-in means positioned above said uppermost conveyor, material output means positioned below a lowermost conveyor of said conveyors, said conveyor belts forming in said second lengthwise half of said housing several pressure chammbers and exhaust chambers alternatingly arranged one above the other, whereby each of said mesh conveyor belts forms a separation plane between respective pressure and exhaust chambers, and at least one exhaust space, wherein said exhaust chambers comprise exhaust openings connecting to said exhaust space, and wherein said pressure chambers comprise inlet openings connecting said pressure chambers to said first lengthwise housing half in which said heat exchanger means is located, and further comprising an additional heat exchanger (35) arranged above the lowest of said mesh belt conveyors, whereby said additional heat exchanger extends across the entire steam through-flow cross-sectional area above said lowest mesh belt conveyor.

11. The steam dryer of claim 10, wherein said material feed-in means comprise material pre-heating means.

12. The steam dryer of claim 11, wherein said material pre-heating means comprise a ring worm screw through which steam may flow.

* * * * *